US005914492A

United States Patent [19]

Wang et al.

[11] Patent Number: 5,914,492

[45] Date of Patent: Jun. 22, 1999

[54] APPLICATION ACCELERATOR SYSTEM HAVING BUNCH CONTROL

[75] Inventors: Dunxiong Wang; Geoffrey Arthur Krafft, both of Newport News, Va.

[73] Assignee: Southeastern Universities Research Assn., Inc., Newport News, Va.

[21] Appl. No.: 08/911,753

[22] Filed: Aug. 15, 1997

[51] Int. Cl.[6] ..... H05H 7/00; G21K 1/00

[52] U.S. Cl. ..... 250/397

[58] Field of Search ..... 250/397

[56] References Cited

U.S. PATENT DOCUMENTS 4,912,330 3/1990 Flesner ..... 250/352

5,661,304 8/1997 Kimura et al. ..... 250/397

*Primary Examiner*—Constantine Hannaher

[57] ABSTRACT

An application accelerator system for monitoring the gain of a free electron laser. Coherent Synchrotron Radiation (CSR) detection techniques are used with a bunch length monitor for ultra short, picosec to several tens of femtosec, electron bunches. The monitor employs an application accelerator, a coherent radiation production device, an optical or beam chopping device, an infrared radiation collection device, a narrow-banding filter, an infrared detection device, and a control.

8 Claims, 1 Drawing Sheet

APPLICATION ACCELERATOR SYSTEM HAVING BUNCH CONTROL

STATEMENT REGARDING FEDERALLY SPONSORED RESEARCH OR DEVELOPMENT

The United States may have certain rights to this invention under Management and Operating Contract DE-AC05-84ER40150 from the United States Department of Energy.

FIELD OF THE INVENTION

This invention relates to a method and apparatus for control and monitoring application accelerators such as free electron laser (FEL) gain by monitoring the bunch length. Free electron lasers are used in the field of high-energy or particle physics and are also envisioned as having a wide range of applications for industrial purposes, such as sterilization of packaged foodstuffs and sterilization of medical instruments. Monitoring the bunch length of the FEL output would insure that the laser is operating at peak current and at highest efficiency.

BACKGROUND OF THE INVENTION

In the field of high-energy or particle physics it is highly desirable to monitor the power level that is produced by a particle accelerator.

An electron radiates with a wide spectrum when it is bent through a dipole, the so-called Synchrotron Radiation (SR). In most cases the SR power is proportional to number of electrons per bunch. However, if the bunch length of the radiating electron beam is short compared to the SR wavelength, the individual electrons radiate in phase and SR power becomes proportional to the square of the number of electrons per bunch, the so called Coherent Synchrotron Radiation (CSR). At long wavelengths the CSR power is enhanced by a large factor proportional to the number of electrons per bunch, with the factor typically in the range of $10^6$ to $10^{10}$. The CSR power has a strong dependence on the longitudinal density distribution, or the bunch length, of the beam.

CSR was theoretically investigated long ago and was first observed in a linear accelerator in 1989. The CSR power can be expressed as:

$$P_{CSR}(\lambda)=P_{inc}(\lambda)*(1+NF(\lambda)) \quad (1)$$

where $P_{CSR}$ and $P_{inc}$ are the coherent power and the incoherent power, respectively, N is the number electrons per bunch, and F is a form factor given by:

$$F(\lambda)=(abs[\int S(z)e^{-2\pi iz/\lambda}dz]\}^2 \quad (2)$$

where normalized S(z) is the longitudinal density distribution.

SUMMARY OF THE INVENTION

An improved apparatus and method have been developed for non-invasively measuring the bunch length for sub-picosecond electron bunches for short bunch particle accelerators such as free electron lasers (FELs), synchronous ring light sources, or high average power electron linear accelerators (linacs) collectively referred to herein as application accelerators. The invention detects the Coherent Synchrotron Radiation (CSR) emitted from such short bunches at a radiation wavelength of the same size as the bunch length to be measured.

The CSR Bunch Length Monitor consists of a coherent radiation production device, an optical or beam chopper, an IR radiation collection device, a narrow banding filter, an IR radiation detection device and a control.

The bunch length monitor of this invention is non-invasive, compact, inexpensive, and features a fast rise time, low noise, high resolution, high sensitivity and may be operated at room temperature.

OBJECTS AND ADVANTAGES

A principal object of the present invention is to provide a low cost method to monitor and control the bunch length or longitudinal density distribution of relativistic particles such as electrons which are radiating in phase or at the Coherent Synchrotron Radiation in a particle beam. By monitoring the bunch length the application accelerator can be kept at peak current and thereby be operated at its highest efficiency.

A second object of the invention is to provide a measurement of the bunch length that is non-invasive and therefore will not degrade the strength of the beam.

Other objects are to provide a bunch length monitor that is compact in size, is capable of operating at room temperature, and exhibits fast rise time, low noise, and high resolution and sensitivity.

Other objects and advantages of the preferred embodiment will become apparent when reading the attached description of the invention and referring to the associated drawings.

DESCRIPTION OF THE DRAWING

The FIGURE is a schematic view of the Application Accelerator System of this invention.

DESCRIPTION OF THE INVENTION

Figure 1:
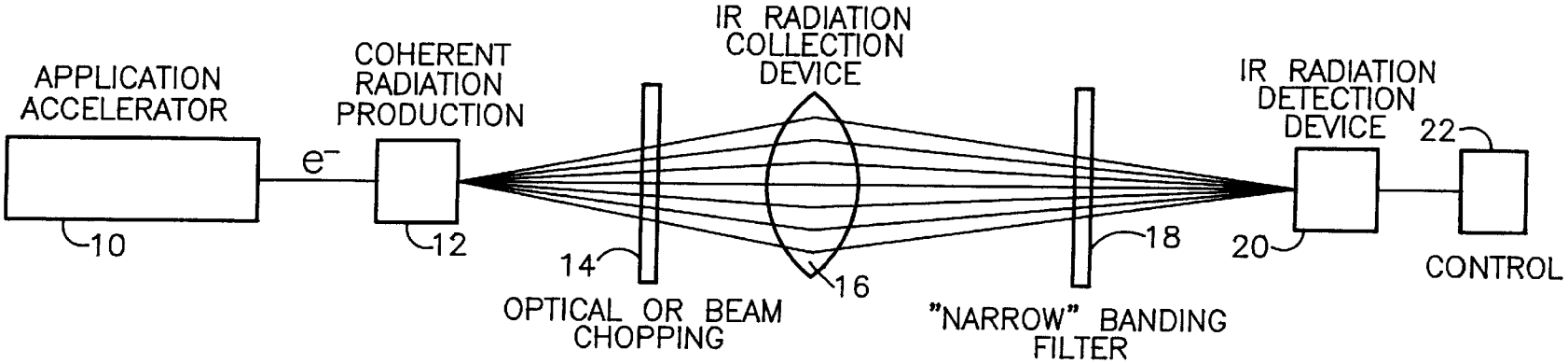

The invention consists of an apparatus and method for monitoring and controlling the gain of a free electron laser or similar application accelerator. One of the properties of FELs that is important is the overall laser gain; on every pass through the machine, the part that is producing the light, it is desirable to get some gain that will allow the coherent radiation to be generated. Laser gain is very sensitive to the peak current in the bunch. Given that there is a certain amount of charge in the bunch, the peak current is raised to the extent that the bunch length is made shorter and shorter. To keep an FEL at peak efficiency, it is necessary to monitor the overall laser gain. The invention consists of a free electron laser gain monitor that keeps the FEL at peak efficiency by continuously measuring the bunch length of the coherent radiation.

The FIGURE is a plan view of the present invention. The monitor and control consists of an application accelerator 10, a coherent radiation production module 12, a beam chopper 14, a radiation collection device 16, a narrow banding filter 18, an IR detection device 20 and a control 22.

The application accelerator 10 may be either a free electron laser, a synchronous ring light source, or a high average power electron linear accelerator collectively referred to here as application accelerators.

The coherent radiation production module 12 may be either synchrotron radiation from bending magnets, transition radiation from thin foils such as mylar plastic film or aluminum, or Smith-Purcell diffraction radiation from diffraction gratings.

The beam chopper 14 may be a rotating or optical mask or a switch system that turns the radiation beam on and off. A control system runs the chopper at a certain frequency synchronized with the radiation beam, with the frequency typically in the range of 60 Hz to 500 Hz. The beam chopper is run for both continuous wavelength radiation and pulse beam. If the beam is a pulse beam, and the beam is synchronized with the chopper, then the signal just feeds through the chopper. If the beam is continuous wavelength, then the chopper interrupts the beam at the selected beam chopping frequency.

The radiation collection device 16 may be an infrared lens or lenses of a parabolic mirror and is associated "narrow" banding filter 18. These devices increase the sensitivity of the FEL gain monitor by permitting only a narrow band of frequencies of the incident radiation to pass through. The radiation collection device 16 can gather input radiation from frequencies of 100 microns to greater than 1 millimeter in length and allow a band from only 400 microns to 600 microns to pass through and impinge on the IR detection device 20. By filtering the radiation and allowing only a narrow band to pass, the power that is detected by the IR detection device is very sensitively dependent on the bunch length.

The "narrow" banding filter 18 may be followed by a quartz window. This allows the radiation to get to the detector, which may be outside the fairly high vacuum, greater then $10^{-6}$ torr, which encloses the radiation beam from the application accelerator 52 through the narrow banding filter 18.

The IR detection device 20 may be a Schottky diode, a pyroelectric detector, a helium cooled bolometer, or a golay cell. Typically the detector is not in the high vacuum environment. If the detector is a Schottky diode or a pyroelectric detector, either of these devices could function in a high vacuum environment, but typically are located outside of it. If the detector is a bolometer or a golay cell, these devices must be located outside the high vacuum environment to function effectively. For the bolometer, helium would transfer into the vacuum, which would be undesirable. The golay cell is a gas cell which would not operate in a high vacuum.

The FEL gain monitor of the present invention would apply to both ultraviolet (UV) and infrared (IR) free electron lasers. Both the UV an IR FELs have the same underlying requirement of a short bunch length to operate at peak power so the invention would detect the same IR radiation in both applications.

The FEL gain monitor is capable of detecting frequencies over a band of 250 microns up to a few millimeters. The coherent radiation wavelength that is detected is directly correlated with the bunch size. As an example, if the FEL is running a 30 micron bunch, then the beam radiation will typically be at 50 microns. As another example, if the FEL is running a 300 micron bunch, then the beam radiation will typically be at 500 microns. So the coherent radiation wavelength is directly correlated to the bunch size.

The shortest bunch size capable of being detected by the gain monitor is typically about 27 microns. The IR detector 20 itself is capable of detecting an even smaller bunch size. The IR detector 20 is capable of detecting also larger bunch sizes up to about 500 microns in size.

The radiation spot at the IR detection device 20 is about 1 millimeter in size. In one example, the radiation before the collection device is about 1.5 centimeter in diameter which is focused by the radiation collection device 16 to a spot size of about 1.0 millimeter.

With the FEL gain monitor in operation, if the bunch size starts to increase, it indicates that the efficiency of the laser gain in the system is starting to decrease.

The bunch length detector of the present invention may be integrated into a control 22 to lock onto the operating bunch length. The control 22 may be used to monitor the IR radiation detection device to manually adjust the system or may be used in the control loop to monitor the operating bunch length of detector 20 to automatically adjust the system.

The main shortcoming of such detectors is that they can not measure the longitudinal profile directly. It is not very sensitive to a long tail with low intensity. Therefore, in practice the bunch length monitor must be calibrated by a reliable measurement such as the zero-phasing using spectrometer and RF cavities. It should be installed at a bending location where beam orbit and size are operationally stable.

In conclusion, a novel bunch length monitor and control for very short (down to femtoseconds) electron bunches has been developed by detecting CSR power. The monitor is non-invasive, compact, low cost, and exhibits fast rise time, low noise, wide dynamic range, high resolution and sensitivity, and operates at room temperature.

A 513 $\mu$m diode is used in measurements in one embodiment to give good response and sensitivity for bunch lengths from a half picoseconds down to several tens of femtoseconds. The resolution of the detector is several femtoseconds for a half picoseconds Gaussian bunch and better for shorter bunches. One can search for the shortest bunch length by means of maximizing the CSR power signal alone, which was done for Gaussian like bunches. The CSR power level is very sensitive to the detailed structure of the longitudinal profile. A diode used was able to detect CSR signals for $6\times10^4$ electrons per bunch with 100 $\mu$s pulse duration at 60 Hz repetition rate.

The method and apparatus of the present control and monitoring of application accelerators is especially suitable for the application requiring a very short bunch and very low average power.

Having thus described the invention with reference to a preferred embodiment, it is to be understood that the invention is not so limited by the description herein but is defined as follows by the appended claims.

What is claimed is:

1. An application accelerator system comprising:

an application accelerator;

a coherent synchrotron radiation production device;

an optical beam chopper;

a coherent synchrotron radiation collection device;

a narrow banding filter;

a coherent synchrotron detection device; and a control.

2. The application accelerator system of claim 1 wherein said application accelerator may be:

a free electron laser;

a synchronous ring light source; or a high average power electron linear accelerator.

3. The application accelerator system of claim 1 wherein said optical beam chopper may be a rotating mask.

4. The application accelerator system of claim 1 wherein said radiation collection device is an infrared radiation collection device and includes:

an infrared lense; or a parabolic mirror.

5. The application accelerator system of claim 1 wherein said detection device may be:

a Schottky diode:

a pyroelectric detector;

a helium-cooled bolometer; or a golay cell.

6. The application accelerator system is claim 1 wherein said control monitors said detection device.

7. The application accelerator system of claim 1 where said control is a part of a control loop for adjusting said application accelerator system.

8. A method for monitoring the gain of a free electron laser including:

producing an incoherent beam of electrons at relativistic speeds with an application accelerator;

converting said incoherent beam of electrons into a coherent beam of electrons with a coherent synchrotron radiation production device;

optically chopping said coherent beam of electrons into separate packets of particles with an optical beam chopping device;

focusing said packets of coherent synchrotron radiation into a tighter beam with an infrared radiation collection device;

filtering a specific frequency of radiation from said coherent synchrotron radiation; and detecting said filtered frequency of coherent synchrotron radiation with an infrared coherent synchrotron radiation detection device.

* * * * *